United States Patent [19]

Hall

[11] Patent Number: 4,864,906

[45] Date of Patent: Sep. 12, 1989

[54] CORE SLABBING MACHINE

[76] Inventor: Troy L. Hall, 410 Cox St., Bastrop, La. 71220

[21] Appl. No.: 150,039

[22] Filed: Jan. 29, 1988

[51] Int. Cl.[4] ..... B65H 73/00

[52] U.S. Cl. ..... 83/886; 83/371; 83/487; 83/614; 83/924

[58] Field of Search ..... 83/487, 485, 54, 614, 83/371, 317, 365, 370, 368, 184, 185, 471.2, 924, 886, 872

[56] References Cited

U.S. PATENT DOCUMENTS

| | | | |
|---|---|---|---|
| 1,838,011 | 12/1931 | St. Peter | 83/924 |
| 3,648,554 | 3/1972 | Arnold et al. | 83/169 |
| 4,506,575 | 3/1985 | McCay et al. | 83/924 |
| 4,597,820 | 7/1986 | Nozaka | 83/365 |

*Primary Examiner*—Donald R. Schran

*Attorney, Agent, or Firm*—John M. Harrison

[57] ABSTRACT

A core slabbing machine for the removal of paper wound on a mill roll core, to thereby permit reuse of the core. The machine includes a horizontal core-receiving mandrel and a carraige which moves horizontally back and forth above, and aligned with, the mandrel. The carriage carries a freely rotatable cutting wheel which is forced downwardly by a pneumatic cylinder onto the paper to be removed from a core. Each horizontal pass of the rotary cutting wheel cuts through a number of layers of paper determined by the force on the cutting wheel. This action is automatically controlled and continues until the cutting wheel reaches the core surface exterior after a number of cutting passes. The freely rotatable cutting wheel exerts a force on the core and paper substantially at right angles to the core and its supporting mandrel, thus obviating the need to anchor the core relative to the mandrel.

18 Claims, 3 Drawing Sheets

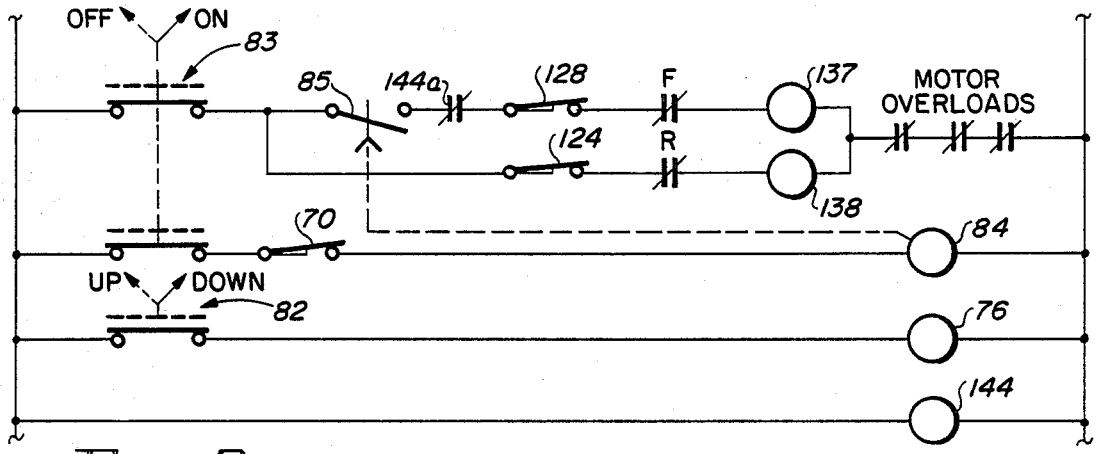
FIG. 3
FIG. 4
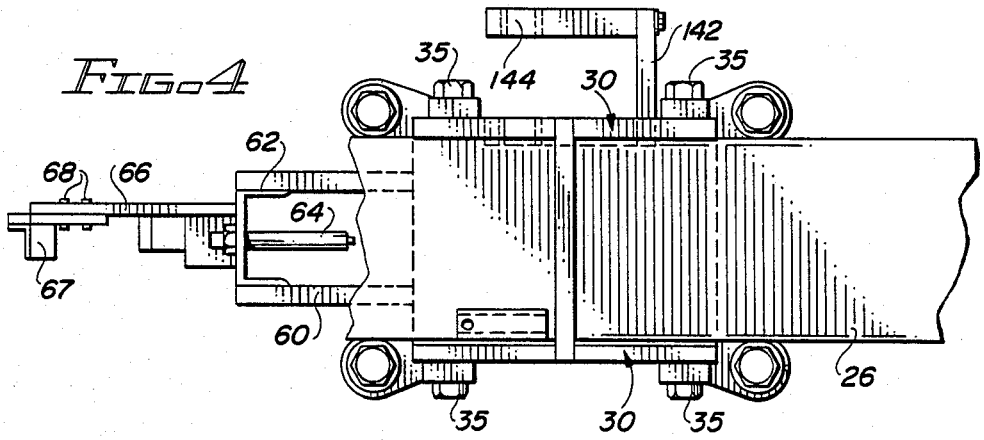
FIG. 5
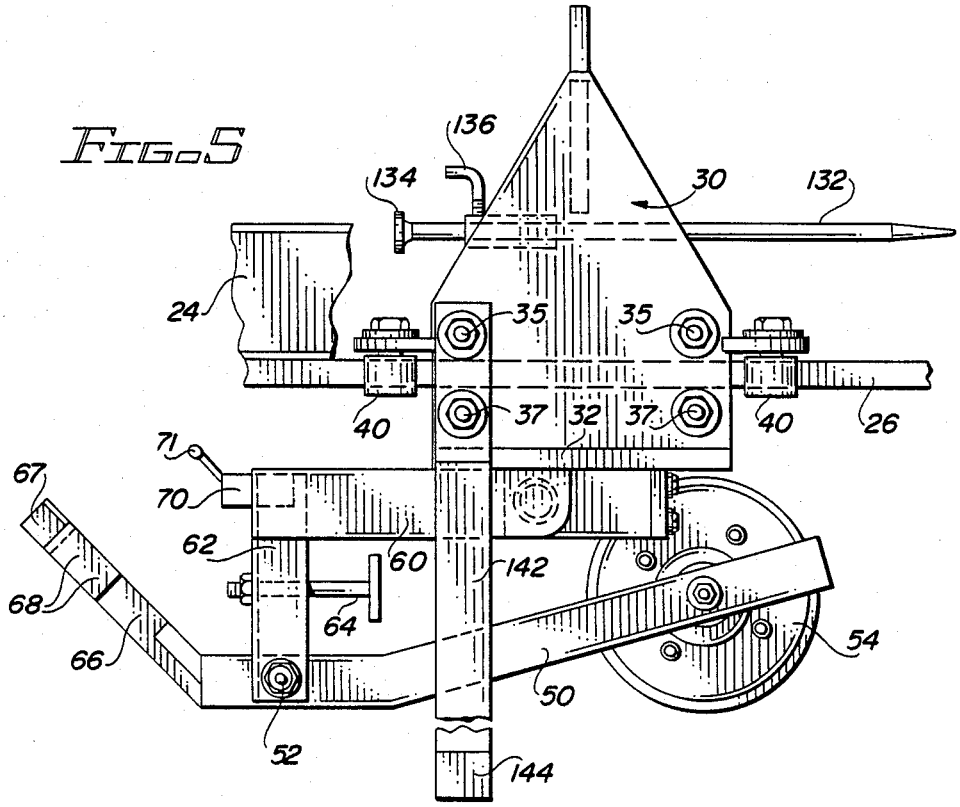

CORE SLABBING MACHINE

BACKGROUND OF THE INVENTION

Field of the Invention

This invention relates to a device for the removal of residual layers of paper from paper mill roll cores. Such a device is often termed a "core slabber", or core slabbing machine.

In the operation of a paper mill wherein large rolls of paper are unwound from a hollow, reusable core and are cut into smaller lengths, it is customary to unwind nearly all of the paper on a roll and then to remove the almost exhausted paper roll, instead of completely unwinding all of the paper from the core. Such substantially exhausted rolls are of no practical use regarding the residual paper left on them. However, the cores are reusable and it is therefore the practice in this art to remove the residual paper from the cores, so that the cores may be reused.

The prior art includes core slabbing machine constructions, a recent example of which is described in McCay, et al. U.S. Pat. No. 4,506,575, dated Mar. 26, 1985, issued to McCay et al. In the McCay construction, a horizontal, cantilevered mandrel is provided, over which the core to be slabbed is placed. This mandrel is expandable, to thereby frictionally lock or engage the core to the mandrel. A horizontally reciprocating knife is positioned above the mandrel, with a motive power means, shown as a motor and sprocket combination, employed to move the cutting knife horizontally back and forth, to thereby make a number of sequential or repeated passes. With each pass, a plurality of layers of paper of the residual paper on the core is removed, with the action continuing until all of the paper is removed from the core. The core is then removed from the core slabbing machine for reuse.

While apparently operative for the purpose of core slabbing, the McCay structure suffers a disadvantage, in that a special mandrel must be employed. This mandrel is of the expanding type, with the frictional force of expansion derived from the mandrel operating to prevent the core from sliding relative to the mandrel during the paper cutting operation. The knife of the McCay construction exerts a horizontal force on the paper, this force being transferred to the core, which action tends to slide the core relative to the mandrel. Without some means to lock the core to the mandrel, movement of the knife relative to the residual paper to cut it results in at least some movement of the core relative to the mandrel, with consequent impairment of the desired paper cutting action of the knife. Another horizontally reciprocating knife for removing residual paper stock from a reusable core is detailed in U.S. Pat. No. 1,838,011, dated Dec. 22, 1931, issued to St. Peter. Corecentering plugs are required in the apparatus and the cutting knives are reversed manually by a lever.

A machine somewhat similar to the present invention is described in U.S. Pat. No. 3,204,501, dated Sept. 7, 1965, issued to Lane. In that machine, a coreless roll of sheet metal (to be cut and scrapped) is placed on a horizontal, cantilevered, hollow mandrel. Each of a plurality of spaced, freely rotatable cutting wheels is mounted on and carried by an endless motordriven sprocket chain, the arrangement including a linear fluid pressure motor which forces the carriage carrying the cutter wheels downwardly against the radially outermost whorls of the sheet metal strip. The direction of horizontal movement of the cutter wheels is apparently the same at all times, one end of the roll of sheet metal shown as abutting the vertical standard to which one end of the mandrel is affixed, to thereby prevent sliding of the roll. No provision is made in the Lane construction for stopping the operation after the cutting wheels have moved any sensed or predetermined downward distance. There being no core within the sheet metal roll, which is to be protected, there is accordingly, no need for any such provision.

SUMMARY OF THE INVENTION

According to the practice of this invention, a core slabbing machine is provided with a freely rotatable, circular cutter blade instead of a knife, which circular cutter blade makes a succession of horizontal passes to cut residual paper from a mill roll core, so that the core may be reused. A number of layers of the residual paper is cut upon each horizontal pass of the cutter wheel. Since a freely rotatable cutter is used, no special modification or construction of the cantilevered mandrel which holds the hollow core is required. The force exerted by the cutting wheel on the residual paper is at right angles to the longitudinal axis of the core being "slabbed" and because the cutting knife is freely rotatable, there is little or no force on the core tending to slide it relative to the mandrel. This design permits the use of a simple cantilevered mandrel, such as is defined by a rigid tube. Further in accordance with the practice of this invention, the operation of removing residual paper from a mill core is substantially fully automatic, it being only necessary to manually place the core on the mandrel and to thereafter initiate operation of the machine. The resulting action is such that the paper cutting and removing process takes place automatically until such time as the residual paper is completely removed from the core. No damage is done to the core and the machine is automatically shut off, after which time the core may be manually removed, with the machine ready for the next operation.

The core slabbing machine of this invention also exhibits utility in removing residual paper from cores of more than one so-called "standard length", it being only necessary to set the machine controls to accommodate a core of selected length.

BRIEF DESCRIPTION OF THE DRAWINGS

The invention will be better understood by reference to the accompanying drawings, wherein:

FIG. 3 is a schematic view of a portion of the electrical control circuit for operating the core slabbing machine;

FIG. 4 is a top plan view, partially in section, of the carriage of the core slabbing machine illustrated in FIG. 1; and FIG. 5 is a side elevational view of the carriage illustrated in FIG. 4.

DESCRIPTION OF THE PREFERRED EMBODIMENTS

Figure 1:
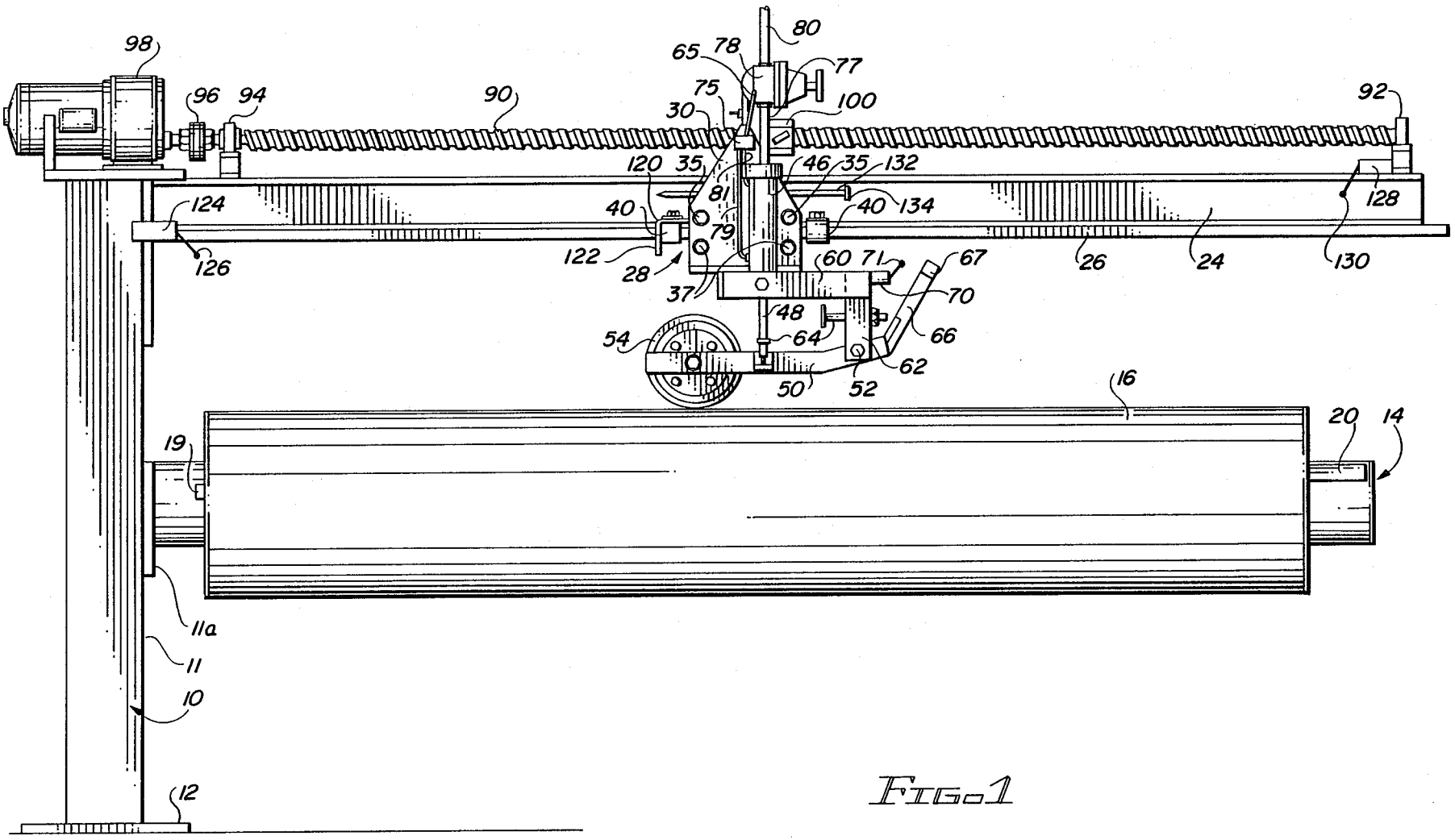
FIG. 1 side elevation of the core slabbing machine of this invention, illustrating a core having residual paper mounted thereon.
Figure 2:
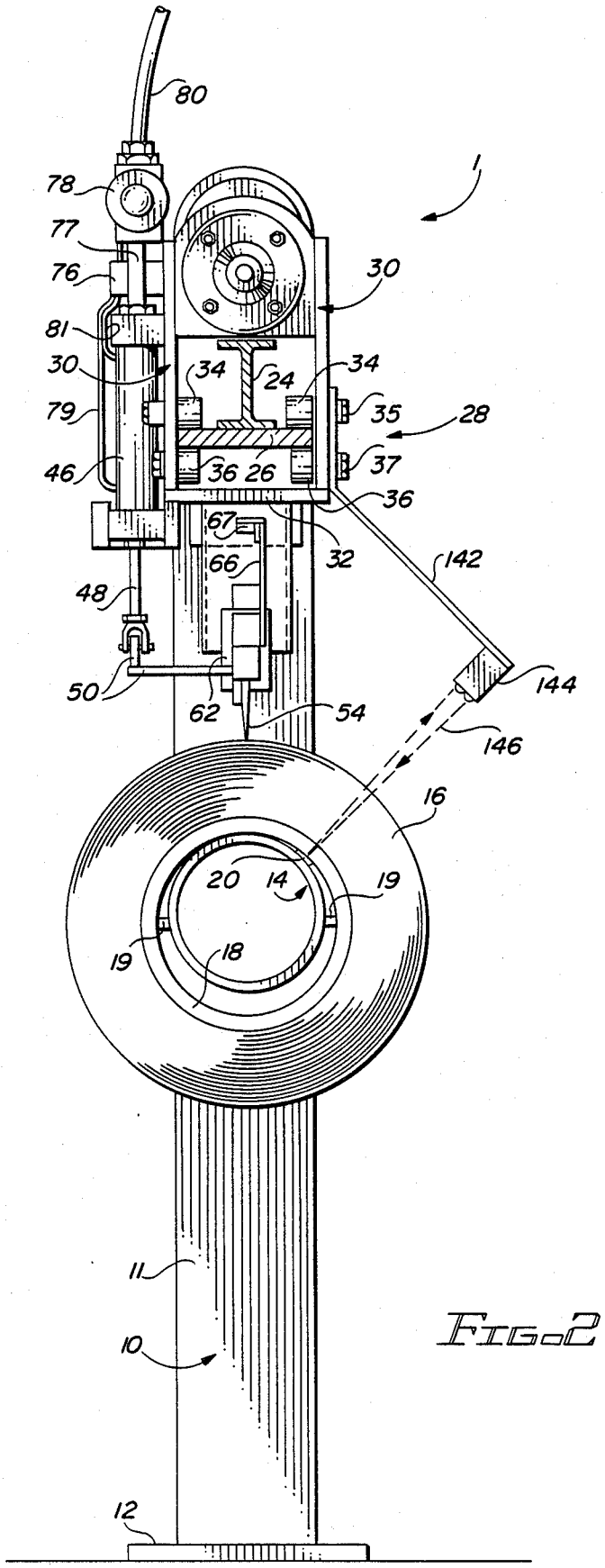
FIG. 2 is an end view of the core slabbing machine illustrated in FIG. 1.

Referring now particularly to FIGS. 1 and 2 of the drawings, reference numeral 10 generally denotes a frame member which includes a vertical standard 11, resting on a base 12. The numeral 14 denotes a horizontally extending, cantilevered mandrel, in the form of a rigid tube, the mandrel being rigidly secured at one end to the standard 11 of the frame 10, by means of a mount plate 11*a*. The numeral 16 denotes residual paper rolled on a reusable core 18, which is of larger diameter than the mandrel 14. The numeral 19 denotes a pair of radially outwardly-extending abutments fixed to diametrically opposite sides of the mandrel 14. These abutments 19 limit and fix the left end of the core 18 relative to the mandrel 14, as the paper 16 is viewed in FIG. 1. The numeral 20 identifies a strip of highly reflective tape or other material placed on the mandrel 14 just beyond the right end of the paper 16. The purpose of this reflective strip 20 is to provide a reflective surface for light transmitted to a photocell, as hereinafter described.

Referring now to FIGS. 1, 2, 4 and 5 of the drawings, the numeral 24 denotes a generally horizontally-extending beam component of the frame 10, and is characterized by a wide-flange structure having an elongated metal plate 26 secured to its lower flange, for example, by welding. The numeral 28 generally denotes a carriage which is slidably supported by the plate 26, the carriage 28 being movable along the plate 26 in a generally horizontal direction, as later described in detail. The carriage 28 includes a pair of vertically-disposed side plates 30, the lower ends of which are spaced by and secured to a horizontal base 32, the side plates 30 and the base 32 defining the main body of the carriage 28. The side plates 30 carry four horizontally-disposed upper cam roller bearings 34, each of which is mounted on a companion upper bolt 35 and has a horizontal axis of rotation, the upper cam roller bearings 34 contacting the upper surface of the elongated plate 26 near its edges. A set of four lower cam roller bearings 36 are horizontally mounted on companion lower bolts 37 and engage the lower surface of the elongated plate 26 at its edges. Additionally, two outside cam roller bearings 40 are bolted on each side of the carriage 28 and roll along opposite sides of the plate 26, as illustrated in FIG. 1. This arrangement provides a stable rolling mount of the carriage 28 on the elongated plate 26.

As further illustrated in FIGS. 1 and 2, the numeral 46 denotes an air cylinder having a piston (not illustrated) therein, the piston secured to a vertically extending rod 48 and the latter attached to a bar 50. The bar 50 is pivoted at a pivot bolt 52 and one end of the bar 50 carries a freely rotatable paper cutting wheel 54. The numeral 60 denotes a bracket secured to the lower portion of the carriage 28, the bracket 60 carrying a downwardly-extending mount 62, the latter further carrying a mount adjustment screw 64. The opposite end of the bar 50 which is remote from the cutting wheel 54 is denoted by the numeral 66 and is tilted at an angle with respect to the horizontal. The numeral 70 identifies a microswitch carried by an extension of the downwardly-extending mount 62 and switch arm 71 of the microswitch 70 is adapted for engagement by an end bracket 67, secured to the opposite end 66 of the bar 50. Set screws 68, illustrated in FIG. 5, permit adjustment of end bracket 67 with respect to the opposite end 66, as further illustrated in FIG. 5.

The numeral 76 denotes a two-way air valve, the input of which is fed through a feed hose 65 from a pressure control valve 78, mounted on the carriage 28, the pressure control valve 78 attached to a flexible hose 80, supplying pressurized air from a suitable source, not illustrated. The pressure control valve 78 is mounted by a support bracket 77 on top of the air cylinder 46. The output of the pressure control valve 78 is connected to either one of the first and second supply hoses 79 and 81, the first supply hose 79 supplying air to the bottom of the piston (not illustrated}of the air cylinder 46 and the second supply hose 81 supplying air to the top of that piston. Thus, operation of the air cylinder 46 moves the bar 50 and the cutting wheel 54 up or down, depending on which way the pressure control valve 78 is actuated. In practice, the pressure control valve 78 may be mounted on a support separate from the automatic core slabbing machine 1, with the first supply hose 79 leading from the pressure control valve 78 to the two-way air valve 76.

Referring again to FIGS. 1, 2, 4 and 5 of the drawings, the numeral 90 denotes an,elongated screw, the ends of which are supported in the spaced bearings 92 and 94. One end of the screw 90 is secured by a coupling 96 to a reversing electric motor 98. The carriage 28 carries an internally-threaded ball nut holder 100, which is fixed to the carriage 28. The arrangement is such that rotation of the screw 90, effected by operation of the electric motor 98, causes movement of the carriage 28 either to the right or to the left on the screw 90, depending upon the direction of rotation of the electric motor 98. An end switch 124 is mounted on the standard 11 adjacent to the plate 26 and is provided with a contact arm 126, the latter adapted to be engaged by an abutment bracket 122, having a top flange 120 provided on one side of the carriage 28. An oppositely-disposed end switch 128 is mounted on the top flange of the beam 24 and is provided with a contact arm 130, which is adapted to be contacted by the head 134 of an adjustable stop 132, which adjustable stop 132 is adjustably mounted in the carriage 28 and is adjusted therein by an adjustment screw 136, as further illustrated in FIG. 5.

As illustrated in FIGS. 2 and 5, a bracket arm 142 is fastened by an upper bolt 35 and companion lower bolt 37 to one of the side plates 30. The lower end of the bracket arm 142 carries a photocell module 144, which projects a light beam 146 (illustrated in phantom) and receives this light beam by reflection from the reflective strip 20, located on the mandrel 14.

Referring again to the drawings, the core slabbing machine 1 removes residual paper 16 from a reusable core 18 in the following manner. The reusable core 18 of a mill roll is first placed on the mandrel 14 adjacent to the abutments 19, as illustrated in FIGS. 1 and 2 and the electric motor 98 is energized. The carriage 28 will then traverse the screw 90 and move to the left, for example, as illustrated in FIG. 1, until the contact arm 126 of the end switch 124 is struck by the abutment bracket 122. Actuation of the end switch 124 by this contact causes reversal of the electric motor 98 and the carriage 28 then moves to the right, until the head 134 of the adjustable stop 132 strikes the contact arm 130 of the oppositely-disposed end switch 128, thereby actuating the oppositely-disposed end switch 128 and causing reverse rotation of the electric motor 98 and hence, reversal of the direction of travel of the carriage 28 along the screw 90. Horizontal adjustment of the adjustable stop 132, which carries the head 134, may be made by manipulating the adjustment screw 136, illustrated in FIG. 5, to accommodate mill rolls having reuseable cores 18 of different length. Adjustment of the adjustment screw 136 thus determines the position of the head 134 of the adjustable stop 132 relative to the carriage 28 and therefore determines the extent of travel to the right (as viewed in FIG. 1), of the cutting wheel 54. The extreme downward movement of the cutting wheel 54 is determined empirically for the first of any number of similar rolls of paper 16 as follows: when the cutting wheel 54 cuts through the rolls of paper 16 and reaches the reuseable core 18, the machine is manually stopped and the mount adjustment screw 64 is manipulated until it abuts the opposite end 66 of the bar 50 and thus prevents further downward motion of the cutting wheel 54. The set screws 68, illustrated in FIG. 5, are also manipulated at this time to adjust the angular position of the opposite end 66, such that the end bracket 67 contacts and actuates the switch arm 71 of the microswitch 70. The core slabbing machine 1 is now set for maximum downward motion of the cutter wheel 54 for subsequent mill rolls of paper 16 having the same reuseable core 18 thickness. The operation is such that the cutting wheel 54 exerts a downward force on the rolls of paper 16, cutting through several layers thereof upon each pass from one end of the reuseable core 18 to the other, until the reuseable core 18 is reached, at which time the machine operation ceases responsive to operation of the microswitch 70 and the bare reuseable core 18 is removed from the mandrel 14. The number of layers of paper 16 removed with each pass of the cutting wheel 54 may be varied by adjusting the pressure control valve 78 according to the hardness of the paper 16. The end switch 124 is so positioned on the frame member 10 with respect to the abutment bracket 122, that the axis of rotation of the butting wheel 54 never extends beyond the left edge of the reuseable core 18 and the paper 16 rolled thereon, as further illustrated in FIG. 1. Similarly, the adjustable stop 132 is positioned relative to the oppositely-disposed end switch 128, such that the axis of the cutting wheel 54 never extends beyond the right edge of the paper 16. Appropriate adjustments are therefore made to control the extent of movement of the carriage 28 on the screw 90 for the different lengths of the various reuseable cores 18.

The photocell module 144 and companion reflective strip 20 perform the same forward limit function as does the oppositely-disposed end switch 128 and both of these forward limit controls, or either one, may be used in operating the core slabbing machine 1, as desired. When the light beam 146 is reflected back from the reflective strip 20 at the desired extreme right-hand position of the carriage 28 as illustrated in FIGS. 1 and 2, a relay (not illustrated) in the forward motor coil line (not illustrated) is actuated to stop forward motion of the carriage 28. Prior to reaching the extreme right-hand end of the reuseable core 18 by the cutting wheel 54, light continuously transmitted from a light source in the photocell module 144 is diffused upon reflection from the relatively non-reflective surface of the paper 16 which is rolled on the reuseable core 18. But upon reaching the end of the reuseable core 18, the continuously transmitted light beam 146 is strongly reflected by the surface of the reflective strip 20, which may, for example, be reflective tape. The reflective strip 20 extends on the mandrel 14 from the right end of the shortest reuseable core 18 to beyond the right end of the longest reuseable core 18.

Referring now to FIGS. 1, 2 and 3 of the drawings, a description of the operation of a preferred three-phase electrical control system for operating the core slabbing machine 1 is as follows: A reuseable core 18 having residual mill roll paper 16 rolled thereon is first placed on the horizontal mandrel 14. The Up/Down selector switch 82 is initially placed in the "Down" position, which closes a circuit that energizes a "down" solenoid (not illustrated) located on the two-way air valve 76. Air is then fed through the second supply hose 81 to the top of the piston of the air cylinder 46 and pushes the cutting wheel 54 against the paper 16. The On/Off selector switch 83 and time delay relay switch 85 are then placed in the "On" position, which energizes a time delay relay 84, which closes instantly. When the time delay relay 84 closes, a "forward" relay (not illustrated) provided in the electric motor 98, is energized. This "forward" relay causes the cutter wheel 54 to travel along the roll of paper 16 toward the frame member 10, as illustrated in FIG. 1. The cutter wheel 54 continues in this direction until it reaches one end of the roll of paper 16, where the end switch 124 opens and the "forward" relay disengages. At this point, the oppositely-disposed limit switch 128 is opened. When the "forward" relay in the electric motor 98 is de-energized, the "reverse" relay (not illustrated) in the electric motor 98 is then energized, reversing the direction of rotation of the electric motor 98 and making the cutter wheel 54 travel in the reverse direction along the roll of paper 16. The cutting wheel 54 continues in this direction until it reaches the opposite end of the roll of paper 16. At this time, the end switch 124 opens, the "reverse" relay disengages and the "forward" relay in the electric motor 98 is again energized. The cutter wheel 54 travels forward again and continues traversing back and forth across the paper 16 in this manner, until the cutter blade 54 reaches the reuseable core 18, when the microswitch 70 is opened. When this happens, the time delay relay 84 starts timing and at the end of a preset time, the "forward" motor coil 137 is de-energized. The cutter wheel 54 then reverses until the end switch 124 is opened at the end of the roll of paper 16. The cutter wheel 54 remains in this dormant position until the On/Off selector switch 83 is turned to the "Off" position and the Up/Down selector switch 82 is then manipulated to the "Up" position. The empty reuseable core 18 is then removed from the mandrel 14. The action is such that when the microswitch 70 is actuated, the carriage 28 makes one last cutting pass along the reuseable core 18 responsive to energizing of the rear motor coil 138, to ensure that the last (radially innermost) layer or layers of residual pair 16 are removed. The core slabbing machine 1 is then ready for the next roll of paper 16 and the On/Off selector switch 83 must be turned to the "Off" position before the Up/Down selector switch 82 is turned o the "Up" position, or the electric motor 98 will start prematurely.

One advantage of employing the photocell module 144, instead of using the forward limit switch 128 to reverse the operation of the carriage 28, lies in the fact that with such use, no forward limit adjustment is required for reuseable cores 18 of different length. Whenever light is reflected from the reflective strip 20 rack to the photocell module 144, reversal of the carriage 28 automatically occurs. Thus, if the photocell module 144 is used exclusively for forward limiting of the carriage 28 travel, the forward photo relay switch 144*a*, illustrated in FIG. 3, is employed, instead of the oppositely-disposed end switch 128.

It will be appreciated by those skilled in the art that while the core slabbing machine is preferably operated by the electrical system illustrated in FIG. 3, other systems may also be used to cause the cutting wheel 54 to traverse the paper 16 to a predetermined depth. Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A core slabbing machine for removing residual layers of papers wound on the hollow core of a mill roll, comprising a frame; an elongated mandrel horizontally mounted on said frame, said mandrel adapted to freely receive the hollow core in non-secured relationship; a carriage movably supported on said framed means for moving said carriage back and forth above the mill roll in a direction parallel to said mandrel; a freely rotatable cutting wheel adjustably carried by said carriage, said cutting wheel oriented in a plane which substantially bisects the longitudinal axis of the mill roll; and pressure means provided in said carriage and connected to said cutting wheel for forcing said butting wheel against the residual layers of paper, whereby the residual layers of paper are cut from the hollow core by said cutting wheel responsive to repeated back and forth motion of said carriage and said cutting wheel.

2. The core slabbing machine of claim 1 further comprising cutting wheel sensing means provided on said carriage for sensing the travel of said cutting wheel through the residual layers of paper, said cutting wheel sensing means adapted to arrest said travel when said cutting wheel reaches the hollow core.

3. The core slabbing machine of claim 2 further comprising adjusting means provided in said carriage for adjusting the actuation of said cutting wheel sensing means.

4. The core slabbing machine of claim 1 further comprising carriage sensing means provided on said frame for limiting the travel of said carriage to thereby permit machine operation on mill rolls of varying lengths.

5. The core slabbing machine of claim 1 wherein said pressure means further comprises a fluid cylinder attached to said carriage, a piston mechanically linked to said cutting wheel and extending from said fluid cylinder and valve means provided in fluid-connection with said fluid cylinder, for selectively moving said cutting wheel both toward and away from the hollow core of the mill roll.

6. The core slabbing machine of claim 4 wherein said carriage sensing means further comprises a pair of switches mounted on said frame in spaced relationship, said switches engageable at predetermined limits of travel by said carriage.

7. The core slabbing machine of claim 4 wherein said carriage sensing means further comprises a photocell module mounted on said carriage and a strip of reflective material provided on one end of said mandrel in close proximity to said photocell module.

8. The core slabbing machine of claim 4 wherein said pressure means further comprises a fluid cylinder attached to said carriage, a piston mechanically linked to said cutting wheel and extending from said fluid cylinder and valve means provided in fluid-connection with said fluid cylinder, for selectively moving said cutting wheel both toward and away from the hollow core of the mill roll.

9. The core slabbing machine of claim 8 wherein said carriage sensing means further comprises a pair of switches mounted on said frame in spaced relationship, said switches engageable at predetermined limits of travel by said carriage.

10. The core slabbing machine of claim 8 wherein said carriage sensing means further comprises a photocell module mounted on said carriage and a strip of reflective material provided on one end of said mandrel in close proximity to said photocell module.

11. The core slabbing machine of claim 10 further comprising cutting wheel sensing means provided on said carriage for sensing the travel of said cutting wheel through the residual layers of paper, said cutting wheel sensing means adapted to arrest said travel when said cutting wheel reaches the hollow core.

12. A core slabbing machine for removing residual layers of paper wound on a hollow core, comprising a frame, a beam carried by said frame and a elongated mandrel extending from said frame in horizontal, cantilever relationship beneath said beam, said mandrel adapted to freely and loosely receive the hollow core and the residual paper wound thereon in non-secured relationship; a carriage movably carried by said beam and adapted to traverse said beam above said mandrel and the hollow core; drive means carried by said beam and linked in driving association with said carriage for causing said carriage to traverse said beam; a freely rotatable cutting wheel carried by said carriage for engaging the layers of paper wound on the hollow core; and pressure means attached to said carriage for applying pressure to the cutting wheel and sequentially forcing said cutting wheel through the layers of paper to the hollow core responsive to traversal of said beam by said carriage.

13. The core slabbing machine of claim 12 further comprising cutting wheel sensing means provided on said carriage for sensing the travel of said cutting wheel through the layers of paper, said cutting wheel sensing means adapted to arrest said travel when said cutting wheel reaches the hollow core.

14. The core slabbing machine of claim 13 further comprising:

(a) adjusting means provided in said carriage for adjusting the actuation of said cutting wheel sensing means; and (b) carriage sensing means provided on said beam for limiting the travel of said carriage to thereby permit machine operation on hollow cores of varying lengths.

15. The core slabbing machine of claim 14 wherein said pressure means further comprises an air cylinder attached to said carriage; a piston mechanically linked to said cutting wheel and extending from said air cylinder and valve means provided in air-connection with said air cylinder, for selectively moving said cutting wheel both toward and away from the hollow core.

16. The core slabbing machine of claim 15 further comprising a pair of abutments fixedly carried by said mandrel for locating the hollow core in a precise position on said mandrel.

17. The core slabbing machine of claim 16 wherein said carriage sensing means further comprises a pair of switches mounted on said beam in spaced relationship, said switches engageable at predetermined limits of travel by said carriage.

18. The core slabbing machine of claim 16 wherein said carriage sensing means further comprises a photocell module mounted on said carriage and a strip of reflective tape provided on one end of said mandrel in close proximity to said photocell module.

* * * * *